US007845819B1

(12) United States Patent
Strong

(10) Patent No.: US 7,845,819 B1
(45) Date of Patent: Dec. 7, 2010

(54) UNDER THE EVE HIDEAWAY LIGHTS

(76) Inventor: Steve J. Strong, P.O. Box 2863, Laguna Hills, CA (US) 92530

( * ) Notice: Subject to any disclaimer, the term of this patent is extended or adjusted under 35 U.S.C. 154(b) by 160 days.

(21) Appl. No.: 12/380,171

(22) Filed: Feb. 24, 2009

Related U.S. Application Data

(60) Provisional application No. 61/198,948, filed on Nov. 12, 2008.

(51) Int. Cl.
*F21V 21/00* (2006.01)

(52) U.S. Cl. ..... 362/145; 362/806; 362/235; 362/374; 362/248; 362/249.14

(58) Field of Classification Search ..... 362/248, 362/374, 387, 267, 371, 388, 145, 249.01, 362/249.16, 249.14; 52/12, 28
See application file for complete search history.

(56) References Cited

U.S. PATENT DOCUMENTS 6,050,709 A * 4/2000 Hastings ..... 362/375
6,363,662 B1 4/2002 Coates
6,364,508 B1 * 4/2002 Moreland ..... 362/241
6,572,239 B1 6/2003 Harbin
6,846,092 B2 * 1/2005 Taylor et al. ..... 362/235
6,955,458 B2 10/2005 Cheema
7,244,039 B1 * 7/2007 Emmons et al. ..... 362/145

* cited by examiner

*Primary Examiner*—Anabel M Ton
(74) *Attorney, Agent, or Firm*—Emery L. Tracy

(57) ABSTRACT

A holiday lights device for use on a building during the holiday season is provided. The holiday lights device comprises an elongated bracket railing having a first end, a second end, a front surface, and a rear surface. A securing mechanism secures the bracket railing to the building. A first latch is secured to the front surface of the bracket railing with the first latch having a first opening and a second latch is secured to the front surface of the bracket railing and spaced from the first latch with the second latch having a second opening. A light railing is provided having a first end, a second end, a front surface, and a rear surface. A first slider bracket is pivotally secured to the rear surface of the light railing and a second slider bracket pivotally secured to the rear surface of the light railing and spaced from the first slider bracket. A string of lights is mounted to the rear surface of the light railing wherein the first slider bracket is receivable within the first opening of the first latch and the second slider is receivable within the second opening of the second latch thereby releasably securing the light railing to the bracket railing and spacing the light railing from the bracket railing and wherein the lights are movable into and out of the space between the light railing and bracket railing.

20 Claims, 3 Drawing Sheets

UNDER THE EVE HIDEAWAY LIGHTS

The present application claims the benefit of priority of pending provisional patent application Ser. No. 61/198,948, filed on Nov. 12, 2008, entitled "Under the Eve Hideaway Lights".

BACKGROUND OF THE INVENTION

1. Field of the Invention

This invention relates generally to holiday lights and, more particularly, the invention relates to a holiday lights device which is easier to install and store after the holiday season than the decorative strings of lights that are currently used during the holiday season.

2. Description of the Prior Art

The Christmas season is a festive time, the annual celebration of the birth of Jesus by the more than 1.2 billion people around the world who are professedly Christian and are associated, however loosely, with a Christian denomination. The 25th of December is celebrated as the actual birthday of Jesus but the Christmas season actually extends from the 24th, Christmas Eve, to January 6th, Epiphany. In this sense, it is also called Christmastide. The Christmas season is also referred to in some areas as Yuletide.

Decorating for the Christmas season is also an international tradition. In addition to a traditional tree, colorful lighting sets are commonly used to add to the festive air of the season, being draped over Christmas trees and windows with many individuals stringing lights across the outside exterior of the house. One of the joys of the holiday season is the proliferation of outside lights and other decorations that brighten and beautify the neighborhoods. Exterior lighting is safe and easy to work with, but you still need to follow some common sense safety precautions.

SUMMARY

The present invention is a holiday lights device for use on a building during the holiday season. The holiday lights device comprises an elongated bracket railing having a first end, a second end, a front surface, and a rear surface. A securing mechanism secures the bracket railing to the building. A first latch is secured to the front surface of the bracket railing with the first latch having a first opening and a second latch is secured to the front surface of the bracket railing and spaced from the first latch with the second latch having a second opening. A light railing is provided having a first end, a second end, a front surface, and a rear surface. A first slider bracket is pivotally secured to the rear surface of the light railing and a second slider bracket pivotally secured to the rear surface of the light railing and spaced from the first slider bracket. A string of lights is mounted to the rear surface of the light railing wherein the first slider bracket is receivable within the first opening of the first latch and the second slider is receivable within the second opening of the second latch thereby releasably securing the light railing to the bracket railing and spacing the light railing from the bracket railing and wherein the lights are movable into and out of the space between the light railing and bracket railing.

DETAILED DESCRIPTION OF THE PREFERRED EMBODIMENTS

Figure 4:
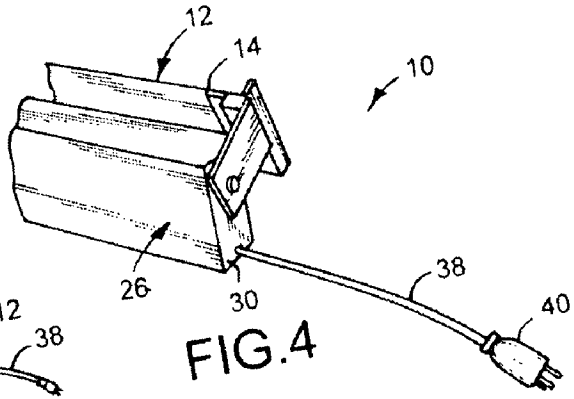
FIG. 4 is a perspective view illustrating an end of the holiday lights device, constructed in accordance with the present invention.
Figure 5:
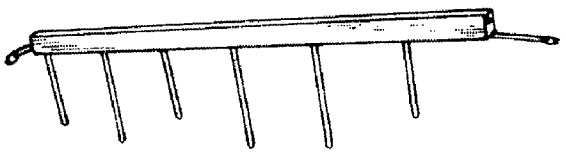
FIG. 5 is a perspective view illustrating the holiday lights device, constructed in accordance with the present invention, with the light rods illuminated.

As illustrated in FIGS. 1-8, the present invention is holiday lights device, indicated generally at 10, which are easier to install and store after the holiday season than the conventional decorative strings of lights that are currently used during the holiday season. The holiday lights device 10 of the present invention hide away under the eve of a building and are preferably a rectangular railing of decorative lights designed for use during the holiday season.

The holiday lights device 10 of the present invention includes an elongated bracket railing 12 having a first end 14 and a second end 16. The bracket railing 12 has plurality of apertures 18 spaced along its length between the first end 14 and the second end 16 with at least one aperture 18 formed adjacent the first end 14 and at least one aperture 18 formed adjacent the second end. Preferably, the bracket railing 12 has three apertures 18 with each aperture sized and shaped for receiving a screw 20 or other fastening mechanism. The screws 20 are inserted into the apertures 18 and tightened into the eve of a building. It should be noted that while the preferred embodiment is to use removable fastening mechanisms such as screws 20, it is within the scope of the present invention to use other types of fastening mechanisms such as nails, bolts, rivets, etc.

The bracket railing 12 of the holiday lights device 10 of the present invention further has a pair of spaced latches with a first latch 22 positioned near the first end 14 of the bracket railing 12 and a second latch 24 positioned near the second end 16 of the bracket railing 12. The latches 22, 24 have an opening for receiving a slider bracket, as will be described in further detail below.

In addition, the holiday lights device 10 of the present invention includes a light railing 26 having a first end 28 and a second end 30. A pair of slider brackets are pivotally secured to the light railing 26 with a first slider bracket 32 mounted adjacent the first end 28 of the light railing 26 and a second slider bracket 34 mounted adjacent the second end 30 of the light railing 26. In a preferred embodiment, the swivel connection between the slider brackets 32, 34 and the light railing 26 is accomplished with a screw 36 that can be loosened allowing pivoting and tightened to releasably lock the swivel of the slider bracket 26 relative to the light railing 12.

Figure 1:
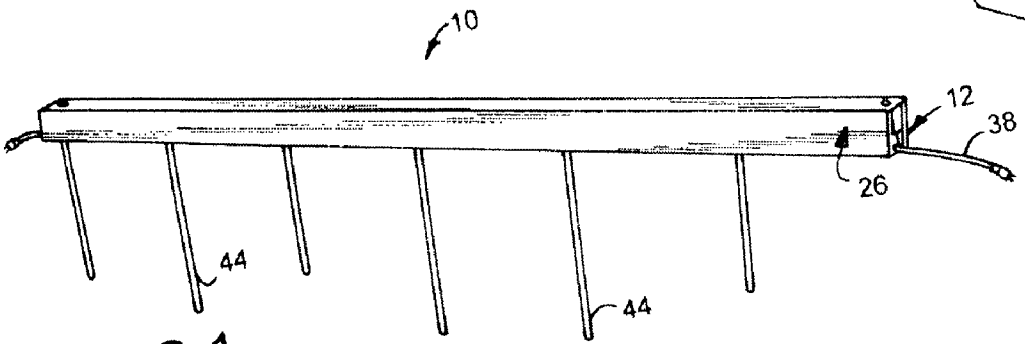
FIG. 1 is a perspective view illustrating holiday lights device, constructed in accordance with the present invention.
Figure 3:
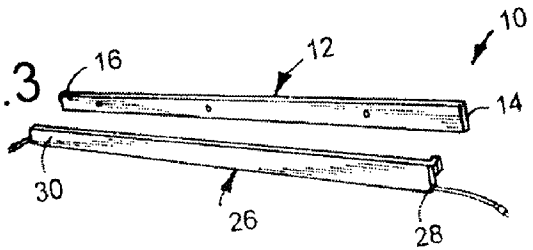
FIG. 3 is a perspective view illustrating the light railing and a bracket railing of the holiday lights device, constructed in accordance with the present invention.
Figure 2:
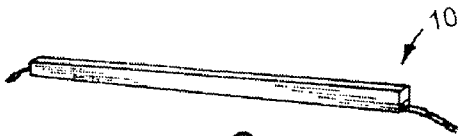
FIG. 2 is a perspective view illustrating a light railing of the holiday lights device, constructed in accordance with the present invention.
Figure 6:
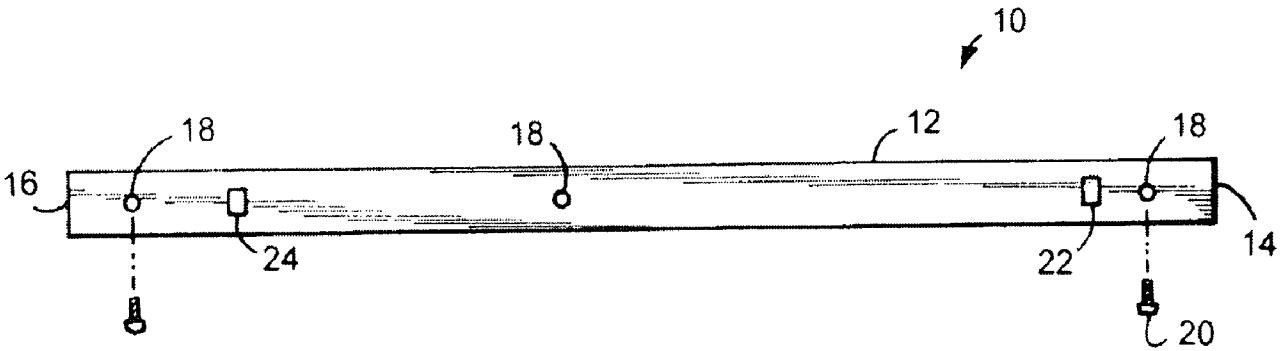
FIG. 6 is a front plan view illustrating the bracket railing of the holiday lights device, constructed in accordance with the present invention.
Figure 7:
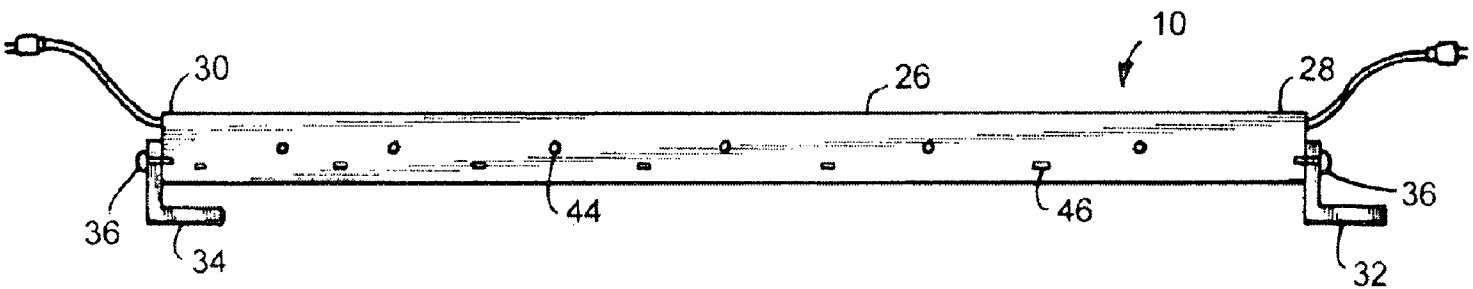
FIG. 7 is a front plan view illustrating the light railing of the holiday lights device, constructed in accordance with the present invention.
Figure 8:
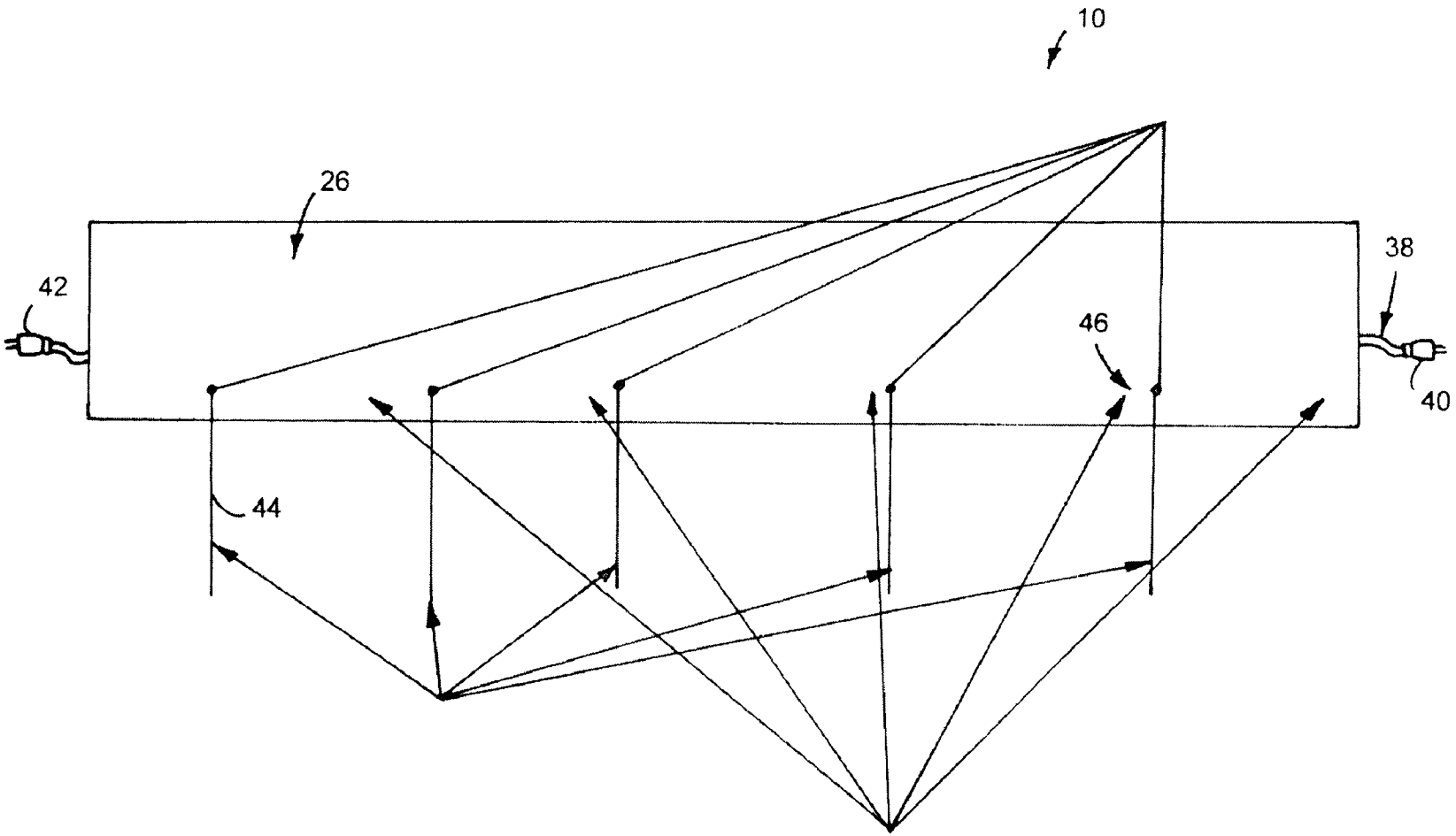
FIG. 8 is a rear plan view illustrating the light railing of the holiday lights device, constructed in accordance with the present invention.

The slider brackets 32, 34 of the holiday lights device 10 of the present invention are receivable within the latches 22, 24, respectively, secured to the bracket railing 12 thereby releasably securing the light railing 26 to the bracket railing 12 with the light railing 26 overlapping the bracket railing 12, as best illustrated in FIG. 1. The pivotal connection of the slider brackets 32, 34 to the light railing 26 allow the light railing 26 to swivel relative to the bracket railing 12 to accommodate angled eves and roof lines. In addition, as discussed above, the swiveling of the light railing 26 relative to the bracket railing 12 can be set in a fixed position thereby releasably locking the position of the light railing 26 relative the bracket railing 12.

The holiday lights device 10 of the present invention further includes a string of lights mounted to the rear surface of the light railing 26. The string of lights is comprised of an electrical cord 38 spanning the length of the light railing 26. Preferably the electrical cord 38 has a male plug 40 extending from the first end 28 of the light railing 26 and a female plug 42 extending from the second end 30 of the light railing 26 allowing the user to connect additional holiday lights devices 10 in series.

In a preferred embodiment, the string of lights have six (6) equally spaced light rods 44 suspended from the light railing 26 such that the light rods 44 hang below the light railing 26 allowing viewing of the lights. While the string of lights has been described as having six (6) light rods 44, it is within the scope of the present invention for the string of lights to have more than six (6) light rods 44 or less than six (6) light rods 44 depending on the desires of the manufacturer and consumer. The length of each of the light rods 40 can be equal to each other or can vary with some light rods 44 being longer or shorter than other light rods 44.

A plurality of corresponding hooks 46 or the like are provided within the light railing 26 allowing the light rods 44 to be moved to a position and held in place by the hooks 46 between the light railing 26 and the bracket railing 12. Preferably, the number of hooks 46 mounted to the light railing 26 is equal to the number of light rods 44. Each of the light rods 44 is removable and replaceable if they need to be repaired and/or replaced.

The dimensions of the bracket railing 26 and the light railing 12 of the holiday lights device 10 of the present invention are preferably approximately fifty-two (52") inches in length, one (1") inch in height, and one-half ('/2") inch in depth. It should be noted that while particular dimensions of the holiday lights device 10 have been set forth, it is within the scope of the present invention for the holiday lights device 10 to have greater or lesser dimensions.

In operation, the first of the holiday lights device 10 in the string is connected to an extension cord or other source of electricity. The suspended light rods 44 can manually be made to swing or set to swing automatically. A switch located on the rear of each of the holiday lights device 44 can be used to select automatic swing and to apply or remove power and select constant or flashing mode of illumination. The light rods 44 can be swung upward and locked in place after the holiday season is over, eliminating the need to remove the holiday lights device 10 for storage.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A holiday lights device for use on a building during the holiday season, the holiday lights device comprising:

an elongated bracket railing having a first end, a second end, a front surface, and a rear surface;

securing means for securing the bracket railing to the building;

a first latch secured to the front surface of the bracket railing, the first latch having a first opening;

a second latch secured to the front surface of the bracket railing and spaced from the first latch, the second latch having a second opening;

a light railing having a first end, a second end, a front surface, and a rear surface;

a first slider bracket pivotally secured to the rear surface of the light railing;

a second slider bracket pivotally secured to the rear surface of the light railing and spaced from the first slider bracket; and a string of lights mounted to the rear surface of the light railing;

wherein the first slider bracket is receivable within the first opening of the first latch and the second slider is receivable within the second opening of the second latch thereby releasably securing the light railing to the bracket railing and spacing the light railing from the bracket railing; and wherein the lights are movable into and out of the space between the light railing and bracket railing.

2. The holiday lights device of claim 1 wherein the securing means is a plurality of apertures formed in the bracket railing, the apertures spaced along the length of the bracket railing between the first end and the second end with one aperture formed adjacent the first end and another aperture formed adjacent the second end, each aperture sized and shaped for receiving a fastening mechanism.

3. The holiday lights device of claim 1 wherein the first latch is positioned near the first end of the elongated bracket and the second latch is positioned near the second end of the elongated bracket.

4. The holiday lights device of claim 3 wherein the first slider bracket is mounted adjacent the first end of the light railing and the second slider bracket is mounted adjacent the second end of the light railing.

5. The holiday lights device of claim 1 wherein the pivot between the slider brackets and the light railing is releasably lockable in any position.

6. The holiday lights device of claim 1 wherein the string of lights has an electrical cord spanning the length of the light railing with the electrical cord having a male plug extending from the first end of the light railing and a female plug extending from the second end of the light railing.

7. The holiday lights device of claim 6 wherein the string of lights has a plurality of spaced light rods suspended from the electrical cord such that the light rods hang below the light railing allowing viewing of the lights.

8. The holiday lights device of claim 7 wherein the length of each of the light rods is equal to each other.

9. The holiday lights device of claim 7 wherein the length of each of the light rods varies from each adjacent light rod.

10. The holiday lights device of claim 7 and further comprising:

a plurality of corresponding hooks mounted to the rear surface of the light railing allowing the light rods to be moved to a position and held in place by the hooks between the light railing and the bracket railing.

11. The holiday lights device of claim 10 wherein the light rods are automatically movable into the space between the light railing and the bracket railing.

12. A method for displaying holiday lights on a building during the holiday season, the method comprising:

providing an elongated bracket railing having a first end, a second end, a front surface, and a rear surface;

securing the bracket railing to the building;

providing a first latch secured to the front surface of the bracket railing, the first latch having a first opening;

providing a second latch secured to the front surface of the bracket railing and spaced from the first latch, the second latch having a second opening;

providing a light railing having a first end, a second end, a front surface, and a rear surface;

pivotally securing a first slider bracket to the rear surface of the light railing;

pivotally securing a second slider bracket to the rear surface of the light railing and spaced from the first slider bracket;

mounting a string of lights to the rear surface of the light railing;

inserting the first slider bracket into the first opening of the first latch;

inserting the second slider into the second opening of the second latch;

creating a space between the light railing from the bracket railing; and moving the lights into and out of the space between the light railing and bracket railing.

13. The method of claim 12 and further comprising:

releasably locking the pivot between the slider brackets and the light railing in a desired position.

14. The method of claim 12 wherein the string of lights has a plurality of spaced light rods suspended from and electrical cord such that the light rods hang below the light railing allowing viewing of the lights.

15. The method of claim 14 and further comprising:

mounting a plurality of corresponding hooks to the rear surface of the light railing;

moving the light rods to a position; and holding the light rods in place by the hooks between the light railing and the bracket railing.

16. The method of claim 14 and further comprising:

automatically moving the light rods into the space between the light railing and the bracket railing.

17. A holiday lights device for use on a building during the holiday season, the holiday lights device comprising:

an elongated bracket railing having a first end, a second end, a front surface, and a rear surface;

securing means for securing the bracket railing to the building;

a first latch secured to the front surface of the bracket railing, the first latch having a first opening;

a second latch secured to the front surface of the bracket railing and spaced from the first latch, the second latch having a second opening;

a light railing having a first end, a second end, a front surface, and a rear surface;

a first slider bracket secured to the rear surface of the light railing by a first releasably locking pivot mechanism;

a second slider bracket secured to the rear surface of the light railing and spaced from the first slider bracket by a second releasably locking pivot mechanism; and a plurality of light rods hanging from an electrical cord, the electrical cord mounted to the rear surface of the light railing;

wherein the first slider bracket is receivable within the first opening of the first latch and the second slider is receivable within the second opening of the second latch thereby releasably securing the light railing to the bracket railing and spacing the light railing from the bracket railing; and wherein the light rods are movable into and out of the space between the light railing and bracket railing.

18. The holiday lights device of claim 17 wherein the first latch is positioned near the first end of the elongated bracket and the second latch is positioned near the second end of the elongated bracket, and wherein the first slider bracket is mounted adjacent the first end of the light railing and the second slider bracket is mounted adjacent the second end of the light railing.

19. The holiday lights device of claim 17 wherein the length of each of the light rods varies from each adjacent light rod.

20. The holiday lights device of claim 17 and further comprising:

a plurality of corresponding hooks mounted to the rear surface of the light railing allowing the light rods to be moved to a position and held in place by the hooks between the light railing and the bracket railing.

* * * * *